United States Patent [19]

Butterworth

[11] 4,413,959

[45] Nov. 8, 1983

[54] SCROLL MACHINE WITH FLEX MEMBER PIVOTED SWING LINK

[75] Inventor: Arthur L. Butterworth, La Crosse, Wis.

[73] Assignee: The Trane Company, La Crosse, Wis.

[21] Appl. No.: 312,556

[22] Filed: Oct. 19, 1981

[51] Int. Cl.[3] ..... F01C 1/02; F01C 17/06

[52] U.S. Cl. ..... 418/14; 418/55; 418/57

[58] Field of Search ..... 418/14, 55, 57

[56] References Cited

U.S. PATENT DOCUMENTS 3,924,977 12/1975 McCullough ..... 418/55

FOREIGN PATENT DOCUMENTS 55-60684 5/1980 Japan ..... 418/14

*Primary Examiner*—John J. Vrablik

*Attorney, Agent, or Firm*—Carl M. Lewis; Ronald M. Anderson

[57] ABSTRACT

A positive fluid displacement apparatus of the scroll type, having a swing link for translating the rotational motion of a drive shaft into the relative orbital motion of two parallel end plates. The facing surfaces of the parallel plates have involute wrap elements attached in fixed angular, intermeshed relationship with each other. Contacting surfaces of the parallel plates and wrap elements define pockets of fluid which are subjected to changes of pressure and volume as the pockets are caused to move between an inlet and an outlet by the orbital motion of the plates.

A flexible member of resilient material connects a crank post on the drive shaft with the swing link and transfers the driving force of the drive shaft to the swing link. The flex member is rigid in tension, but flexible in bending. By its spring force, the flex member biases the wrap elements slightly apart when the drive shaft is not rotating, to reduce the driving torque required at start-up of the scroll apparatus.

12 Claims, 4 Drawing Figures

SCROLL MACHINE WITH FLEX MEMBER PIVOTED SWING LINK

TECHNICAL FIELD

This invention generally pertains to positive fluid displacement machines of the scroll type, and specifically to a scroll machine having a swing link for translating the rotational motion of a drive shaft into the orbital motion of scroll wraps.

BACKGROUND ART

Scroll type positive fluid displacement apparatus typically include parallel plates having involute wrap elements attached in intermeshed, angular relationship. The axes of the wrap elements are normally parallel and offset such that their relative orbital motion causes pockets of fluid defined by flank surfaces of the wrap elements and the end plates, to move between an inlet port and an outlet port.

Depending upon the configuration of the involute wrap elements and the relative direction of their orbital motion, a scroll machine may function as an expander (vacuum pump), a compressor, or a liquid pump. When used as an expander, the pockets of fluid moving through the machine originate near the center of the involutes and expand in volume as they move outward around the wraps. Conversely, in a scroll compressor, pockets of fluid move inward around the scroll wraps to a center discharge port, experiencing a substantial reduction of their volume in the process. In a liquid pump, each of the involute wraps makes only a single loop about the central axis such that the pockets of liquid are not subjected to a significant change in volume, but are simply forced to move around the scroll between an inlet port and a discharge port, exiting at a higher pressure.

The operating efficiency of a scroll machine is particularly dependent upon the effectiveness of the seal between the flank surfaces of the involute wraps in the radial direction, and between the tip of the wraps and the facing end plate in the axial direction. For applications where effective radial sealing is less important, a small clearance may be maintained between the flank surfaces of the intermeshed scrolls such that they do not contact each other. This design has been referred to as a "fixed-crank" type scroll machine, an example of which is disclosed in U.S. Pat. No. 4,082,484. In a more common approach generally providing higher operating efficiency, the flank surfaces of the intermeshed wrap elements are caused to contact each other with sufficient force to achieve radial sealing. A scroll machine so configured is thus conveniently referred to as a "radially compliant" type.

U.S. Pat. No. 3,924,977 discloses a radially compliant linking means for linking a driving mechanism to an orbiting scroll member. In the '977 patent, two embodiments are shown for providing radial compliance—a swing link, and a sliding-block linkage. In the first, the axis of the swing link is perpendicular to the eccentricity radius of the orbiting scroll and comprises a connecting rod mounted on a drive shaft crank pin, a bearing assembly, and a spring loaded assembly arranged to partially offset the centrifugal force on the orbiting scroll member when the drive mechanism is turning at normal operating speed. At start-up, the centrifugal force on the scroll member is nil and the centripetal force applied by the spring causes the scroll member to orbit with an eccentricity radius less than normal. The drive mechanism, e.g., electric motor, does not have to develop significant torque upon start-up, since the flanks of the involute wrap elements are initially not in sealing contact.

In another U.S. patent application, Ser. No. 195,289, assigned to the same assignee as the present application, a scroll type machine is disclosed having a swing link to effect radial compliance, with counterweight means to provide an offsetting centripetal force to the centrifugal force on the orbiting scroll member. Unlike the spring loaded assembly of the '977 patent, the counterweighted swing link disclosed in this application insures adequate radial sealing between the flanks of the scroll members, independent of the operating rotational speed of the machine. The application discloses a coiled spring captive within the swing link which acts against a post on the end of the drive shaft to bias the flank surfaces of the involute wraps slightly apart when the apparatus is at rest, thereby reducing the starting torque required of the driving mechanism.

A potential problem exists with regard to the prior art swing link designs discussed above. The pivot pin bearing in the swing link may be subject to fretting due to the relatively high loads and small relative motion to which it is exposed. The limited motion of the swing link about the pivot pin is conducive to fretting because wear particles tend to become trapped in the load bearing area rather than being carried out, as would be the case if there was substantial motion between the swing link and pin, e.g., if the swing link rotated about the pin.

In view of these potential problems with the swing link design disclosed in the prior art, it is an object of this invention to provide an alternative swing link with radial compliance, having the means to couple the drive shaft to the swing link and to bias the wrap elements apart in one element.

It is a further object of this invention to eliminate the pivot pin and bearing to avoid potential fretting problems.

A still further object is to simplify the radial compliant swing link.

These and other objects of the invention will be apparent from the description of the preferred embodiment which follows, and from the attached drawings.

DISCLOSURE OF THE INVENTION

The subject invention is a scroll type positive fluid displacement apparatus. It includes two generally parallel plates, each having an involute wrap element attached to their facing surfaces. The wrap elements are in fixed angular, intermeshed relationship with each other, with pockets of fluid being defined between the contacting surfaces of the plates and the wrap elements.

The apparatus also comprises a drive shaft rotatably driven about its longitudinal axis and having a crank post at one end, which is offset from the longitudinal axis. Swing link means couple the drive shaft in radial compliance to one of the two parallel plates so that rotation of the drive shaft causes the involute wrap associated with that plate to orbit within the involute wrap of the other plate, thereby forcing pockets of fluid to move between an inlet and an outlet.

A flexible member of flexible material connects the crank post with an adjacent parallel surface of the swing link means. The flex member is rigid in tension, but flexible in bending so that its resilient force biases the involute wrap elements slightly apart when the drive shaft is not rotating. This reduces the driving torque required of the drive shaft during start-up of the scroll apparatus.

DESCRIPTION OF THE PREFERRED EMBODIMENT

Figure 1:
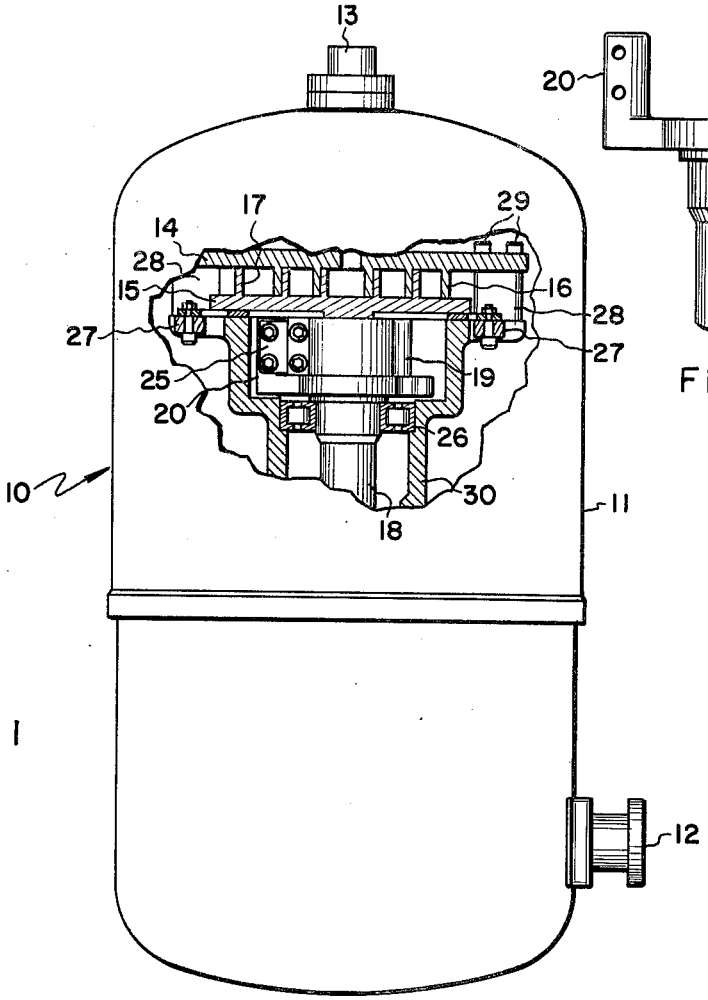
FIG. 1 shows a cut-away view of the scroll machine in which the scroll elements, drive shaft, and flex member are disclosed in cross-sectional aspect.

With reference to FIG. 1, the subject invention is shown in a preferred embodiment, in which it is incorporated in a refrigerant compressor 10 of the scroll type. Scroll compressor 10 includes a hermetic shell 11 having a suction port fitting 12 and a discharge port fitting 13 attached thereto. During operation of scroll compressor 10, refrigerant fluid is drawn through suction port 12, passes through the rotor gap of an electric motor (not shown) to cool the windings, is drawn into the scroll apparatus between plates 14 and 15, and is compressed by the relative orbital motion of scroll involutes 16 and 17, thereafter being discharged through discharge port 13.

In this embodiment of the preferred invention, scroll plate 14 is fixed, while scroll plate 15 is driven in an orbital motion by the rotation of drive shaft 18. The rotation of drive shaft 18 is transmitted to orbiting scroll plate 15 by means of a swing link 19. Swing link 19 converts this rotational motion into an orbital motion, and serves to effect radial compliance, while the mass of the lobular portion of swing link 19 provides a counterweight to offset the centrifugal force experienced by orbiting scroll plate 15.

The upper end of drive shaft 18 terminates in a crank having an upwardly extending crank stub 20 which is offset from the longitudinal axis of drive shaft 18. Crank stub 20 is connected to swing link 19 by means of a flexible member 25 having a resilient characteristic so that it resists bending deformation. A roller bearing 26 positions drive shaft 18 centrally within the hermetic shell 11 of compressor 10.

A fixed angular relationship between orbiting scroll plates 14 and 15 and their respective involute wraps 16 and 17 is maintained by an Oldham coupling 27 as is well known in the prior art (see for example U.S. Pat. No. 4,065,279). Fixed scroll plate 14 is held in place by columnar blocks 28, which are disposed at four spaced apart positions around the periphery of scroll plates 14 and 15, and held in place by bolts 29. The fixed scroll plate 14 is thus attached to a crankcase housing 20.

Figure 4:
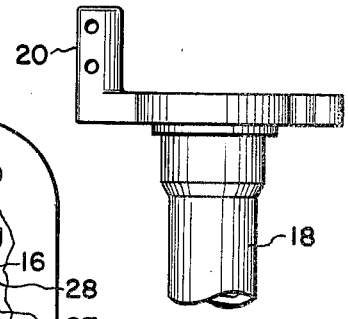
FIG. 4 shows the crank post portion of the drive shaft in elevational view, with the surrounding elements removed for clarity.
Figure 2:
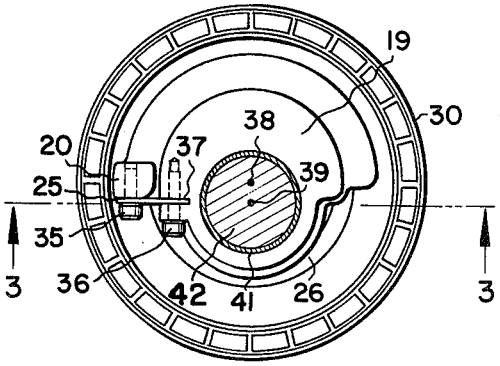
FIG. 2 is a plan view of the radially compliant swing link and the associated elements by which it is connected to the drive shaft.
Figure 3:
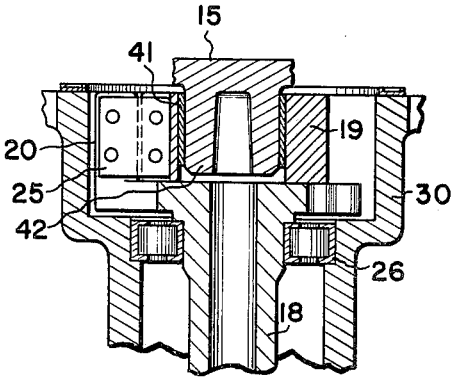
FIG. 3 is taken along section line 3—3 of FIG. 2 and shows the swing link, part of the orbiting scroll plate, crank post, and flex member in cross-sectional view.

Referring now to FIGS. 2–4, the operational relationship between crank stub 20, flex member 25, and swing link 19 are more clearly disclosed. For example, FIG. 2 shows how bolts 35 are used to secure one side of flex member 25 to crank stub 20, the other side extending to swing link 19 where it is attached by bolts 36. As shown in the preferred embodiment (FIG. 2), flex member 25 is seated within slot 37 of swing link 19; however, it is also contemplated that slot 37 could be eliminated and flex member 25 merely secured to a flat surface of swing link 19. Crank stub 20 includes a rounded portion adjacent flex member 25, such that during acceleration of drive shaft 18 in a clockwise direction as viewed from above, flex member 25 may be slightly deformed around this curved portion of crank stub 20 without being subjected to a sharp edge. In the Figures, flex member 25 is substantially undeformed by bending—a condition that prevails when the scroll compressor is de-energized, and drive shaft 18 is not rotating.

During operation of compressor 10, drive shaft 18 rotates about a central longitudinal axis, represented by an imaginary point 38. Point 38 thus also comprises the center of rotation for crank stub 20. Rotation of crank stub 20 about point 38 is transmitted by flex member 25 to swing link 19, causing it to rotate in turn about an imaginary point 39 which is displaced slightly from point 38. The relative displacement of points 38 and 39 comprises the radius of eccentricity for involute wraps 16 and 17. Swing link 19 includes a bore 40 centered about point 39 and a journal bearing 41 fitted within that bore to accommodate the orbiting scroll drive pin 42. It will be apparent that as swing link 19 rotates about imaginary point 39, point 39 and orbiting scroll plate drive pin 42 both orbit about the longitudinal axis of drive shaft 18 which runs through point 38. Drive pin 42 is attached to orbiting scroll plate 15 such that involute wrap 17 orbits relative to the fixed involute scroll wrap 16. This orbital action causes pockets of fluid to move around the involute wraps 16 and 17, radially inward, while experiencing a reduction in volume and an increase in pressure. The compressed fluid is thereafter discharged from compressor 10 through discharge port 13 as previously discussed.

When drive shaft 18 is not rotating, the resilience of flex member 25 causes it to assume its undeformed planar shape, parallel to the longitudinal axis of compressor 10. This resilience or restoring spring force is transmitted through swing link 19 to orbiting scroll plate 15 which is at rest, and acts to reduce the eccentricity radius of involute wraps 16 and 17 by a very small amount, effectively reducing slightly the distance between center points 38 and 39. Furthermore, due to the relationship of swing link 19 and orbiting scroll plate 15 discussed hereinabove, this results in a slight separation between the flank surfaces of involute wraps 16 and 17, thereby reducing the effectiveness of the fluid seal between these surfaces normally provided by radial compliance when compressor 10 is operational. As drive shaft 18 begins to rotate after compressor 10 is energized, flex member 25 is deformed around crank stub 20, such that within one revolution of drive shaft 18, the flank surfaces of involute wraps 16 and 17 are brought together in a moving line contact, with sufficient force due to the radial compliance of swing link 19, to effect a fluid seal. The initial fluid leakage between the flank surfaces of wraps 16 and 17 permits the driving mechanism, e.g., electric motor, to start up with reduced driving torque.

Although flex element 25 is thin and flexible in bending, it is anticipated that it will be made of a relatively hard spring steel material having substantial stength and rigidity in tension. The section modulus of flex member 25 should be selected as required to control fluid leakage to minimize start-up torque, while avoiding the condition in which involute wraps 16 and 17 slap together suddenly as the drive shaft 18 gains too much rotational speed, causing potential damage to the driving mechanism. Likewise, the gap between the flank surfaces of wrap elements 16 and 17 at start-up may also affect this condition, and should be carefully selected.

Although the preferred embodiment of the invention as described above has been applied to a refrigerant fluid compressor, it should also be understood that it is equally applicable to expanders or pumps of the scroll type. Such modifications will be apparent to those skilled in the art within the scope of the invention, as defined in the claims which follow.

I claim:

1. A scroll type positive fluid displacement apparatus comprising a. two generally parallel plates, the facing surface of each having an involute wrap element attached thereon in fixed angular, intermeshed relationship with each other, contacting surfaces of said plates and wrap elements defining pockets of fluid;

b. a drive shaft rotatably driven about its longitudinal axis, said drive shaft at one end thereof, having a crank post offset from the longitudinal axis of the drive shaft;

c. swing link means for coupling the drive shaft in radial compliance to one of the two parallel plates so that rotation of the drive shaft causes the involute wraps associated with said one of the plates to orbit within the involute wrap of the other plate, thereby causing pockets of fluid to move between an inlet and an outlet; and d. a flex member of resilient material connecting the crank post of the drive shaft with an adjacent parallel surface of the swing link means and operative to transmit rotational driving force from the drive shaft to the swing link, said flex member being rigid in tension, but flexible in bending, so that by its spring force it biases the involute wrap elements slightly apart when the drive shaft is not rotating, to reduce the driving torque required upon start-up of the scroll apparatus.

2. The apparatus of claim 1 wherein said one of the parallel plates includes a drive pin on its face opposite that on which the involute wrap element is affixed, said drive pin engaging a circular bore in the swing link means and having an axis parallel to and offset from the longitudinal axis of the drive shaft.

3. The apparatus of claim 2 wherein said flex member is substantially flat and is mounted so that its surface lies in a plane which is parallel to the longitudinal axis of the drive shaft.

4. The apparatus of claim 3 wherein said plane is substantially normal to a plane running through the axis of the drive pin and the longitudinal axis of the drive shaft.

5. The apparatus of claim 1 wherein the flex member is connected to the drive shaft crank post with one or more bolts.

6. The apparatus of claim 5 wherein the flex member is seated in a slot formed within the swing link means, and is held in place by one or more bolts.

7. A scroll type positive fluid displacement apparatus comprising a. a first end plate, having affixed to a flat surface thereof a first involute wrap element which defines inner and outer flank surfaces in spiral configuration about a first axis;

b. a second end plate, with a flat surface substantially parallel to and facing the flat surface of the first end plate and having a second involute wrap element affixed thereto which also defines inner and outer flank surfaces in spiral configuration about a second axis, said first and second involute wrap elements being disposed in intermeshed, angularly offset relationship so that pockets of fluid are sealingly defined between the inner and outer flank surfaces of the first and second involute wrap elements and the flat surfaces of the end plates;

c. a drive shaft rotatably driven about a longitudinal axis which is generally parallel to and offset from said first and second axes of the first and second wrap elements, said drive shaft having a crank post offset from its longitudinal axis, adjacent the end plates;

d. swing link means for coupling the drive shaft in radial compliance to the first end plate so that rotation of the drive shaft causes the first involute wrap element to orbit with respect to the second involute wrap element and end plate, whereby the points at which the flank surfaces of the wrap elements contact each other move along their spiral path, thereby changing the pressure and volume of the pockets of fluid as they move between an inlet and an outlet;

e. a flex member comprising a substantially thin resilient material connecting the crank post of the drive shaft with an adjacent surface of the swing link means and operative to transmit rotational driving force from the drive shaft to the swing link, said crank post, flex member, and surface of the swing link means being parallel with the longitudinal axis of the drive shaft, and said flex member being rigid in tension, but flexible in bending about the crank post, so that by its spring force, it biases the first and second involute wrap elements slightly apart when the drive shaft is not rotating, to reduce the driving torque required upon start-up of the scroll apparatus.

8. The apparatus of claim 7 wherein said first end plate includes a drive pin disposed opposite the first involute wrap element, said drive pin operative to engage a circular bore in the swing link means, both the drive pin and the bore having an axis of rotation parallel to and offset from the longitudinal axis of the drive shaft, and said bore being provided with a bearing surface to permit the swing link means to rotate freely about the drive pin.

9. The apparatus of claim 8 wherein said flex member comprises a flat spring of generally rectangular shape which extends from the drive shaft crank post to the adjacent surface of the swing link means in a plane substantially parallel to the longitudinal axis of the drive shaft.

10. The apparatus of claim 9 wherein said plane is substantially normal to a plane running through the axis of the drive pin and the longitudinal axis of the drive shaft.

11. The apparatus of claim 7 wherein the flex member is seated in a slot formed within the swing link means and extends across an intervening gap to a flattened surface on the drive shaft crank post.

12. The apparatus of claim 7 wherein the flex member is connected to the drive shaft crank post and the swing link means by means of bolts.

* * * * *